US007574011B2

(12) United States Patent
Meyer et al.

(10) Patent No.: US 7,574,011 B2
(45) Date of Patent: Aug. 11, 2009

(54) DETECTION DEVICE

(75) Inventors: Rolf Meyer, Wennigsen (DE); Klaus-Michael Polten, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 567 days.

(21) Appl. No.: 10/556,020

(22) PCT Filed: Mar. 25, 2004

(86) PCT No.: PCT/EP2004/003150

§ 371 (c)(1),
(2), (4) Date: Nov. 7, 2005

(87) PCT Pub. No.: WO2004/100601

PCT Pub. Date: Nov. 18, 2004

(65) Prior Publication Data

US 2006/0215856 A1 Sep. 28, 2006

(30) Foreign Application Priority Data

May 7, 2003 (DE) ..... 103 20 190

(51) Int. Cl.
*H04R 3/00* (2006.01)
*H04R 1/02* (2006.01)

(52) U.S. Cl. ..... 381/113; 381/122; 381/91

(58) Field of Classification Search ..... 381/77, 381/79, 91, 122, 111, 112, 113, 114, 92, 381/356; 439/577

See application file for complete search history.

(56) References Cited

U.S. PATENT DOCUMENTS

| | | | |
|---|---|---|---|
| 4,745,298 | A | 5/1988 | Iwamatsu |
| 6,185,627 | B1 | 2/2001 | Baker et al. |
| 6,757,398 | B2 * | 6/2004 | Foley ..... 381/123 |

FOREIGN PATENT DOCUMENTS

| | | |
|---|---|---|
| DE | 39 33 870 | 4/1991 |
| DE | 42 07 447 | 9/1993 |
| DE | 44 27 396 | 2/1996 |
| DE | 196 00 404 | 8/1996 |
| DE | 196 06 261 | 4/1998 |
| JP | 62-276998 | 12/1987 |
| JP | 60 06415 | 1/1994 |
| JP | 2000-217200 | 8/2000 |
| KR | 2002-0090264 | 12/2002 |

* cited by examiner

*Primary Examiner*—Xu Mei
(74) *Attorney, Agent, or Firm*—Reed Smith LLP

(57) ABSTRACT

The invention is based on the idea of providing a detection device which is capable of distinguishing whether a microphone or audio signal processing arrangement connected thereto operates on an analog or digital basis. An analog or digital connection is selected in accordance with that determination procedure. Consequently there is provided a detection device which has a sensing device, a determining device and a selecting device. The sensing device senses an external signal fed to the detection device and forwards that signal to the determining device. The determining device determines whether the sensed external signal was transmitted by an analog or digital signal processing apparatus and transmits a corresponding determination signal to the selecting device. The selecting device then selects either an analog or a digital connection, in dependence on the determination signal.

8 Claims, 1 Drawing Sheet

DETECTION DEVICE

CROSS-REFERENCE TO RELATED APPLICATIONS

This application claims priority of International Application No. PCT/EP2004/003150, filed Mar. 25, 2004 and German Application No. 103 20 190.4, filed May 7, 2003, the complete disclosures of which are hereby incorporated by reference.

BACKGROUND OF THE INVENTION a) Field of the Invention

The invention concerns a detection device for determining whether a digital or analog audio signal processing apparatus is connected to the detection device; a microphone having such a detection device; an XLR plug with such a detection device and an audio signal processing arrangement with such a detection device.

b) Description of the Related Art

Microphones with both an analog output and also microphones with a digital output are known. The interface of a microphone with an analog output is described in the standard IEC 268 and the interface of a digital microphone is described in the standard AES 42.

As general state of the art, attention is to be directed to DE 42 07 447 A1, DE 196 00 404 A1, DE 44 27 396 A1 and DE 196 06 261 C2.

In the known microphones, a distinction is drawn between electrodynamic sound transducers and microphones with electrostatic sound transducers. The electrodynamic sound transducers generally pass the unamplified output signal directly to subsequent audio signal processing arrangements. Such microphones therefore do not require any internal or external feed voltage.

Microphones with electrostatic sound transducers such as, for example, capacitor or electret microphones in contrast require an internal or external voltage supply for operation of their internal amplifier. The signal coming from the electrostatic sound transducer is amplified and then fed to the following audio signal processing arrangements.

The following audio signal processing arrangements can include, for example, microphone (pre-) amplifiers, amplifiers, mixing desks, magnetic tape recording arrangements, hard disk recorders, so-called stage boxes which stand on a stage and other signal processing arrangements which have amplifiers, analog/digital converters (DAC), filters or the like. To reduce the cables required for the microphones, the habit has been adopted in many areas of ensuring the power supply for the microphones with a so-called phantom feed in accordance with IEC 268. In that case, the cable between the microphone and the subsequent signal processing means, which is usually employed for transmission of the audio signals from the microphone to the subsequent signal processing means, is also used to provide the signal voltage for the microphone through the subsequent signal processing means. In the case of analog microphones and analog signal processing arrangements that voltage is 48 volts.

A supply voltage of 10 volts is prescribed, however, for microphones with a digital output, in above-mentioned standard AES 42. That supply voltage for the digital signal output of a microphone, as described above, is afforded by the subsequent signal processing arrangement by way of the cable between the microphone and the signal processing arrangement. The standard for the digital interface between microphone and signal processing arrangement (AES 42) further provides for transmission of a dialog protocol (DPP) for determining status and setting the corresponding parameters such as for example sampler rate, impact-sound filter and the like.

Usually the XLR plugs and cables which are already used for analog microphones are also used for digital microphones. In practice, however, that gives rise to certain problems in regard to handling both analog and also digital microphones and audio signal processing arrangements. In particular, that can involve a confusion of digital and analog microphones, which leads to considerable uncertainty in terms of handling such microphones. That can give rise to problems, in particular, when the users do not have sufficient time to test the respective microphones or signal processing arrangements to ascertain whether they are designed for analog or digital operation.

OBJECT AND SUMMARY OF THE INVENTION

Accordingly, the primary object of the invention is to expand the possible uses of digital and analog microphones as well as analog or digital signal processing arrangements.

That object is attained by a detection device in accordance with the invention for determining whether an analog or digital audio signal processing apparatus is connected to the detection device; by a microphone in accordance with the invention having such a detection device; by an XLR plug in accordance with the invention having such a detection device; and by an audio signal processing arrangement in accordance with the invention having such a detection device.

In that respect, the invention is based on the idea of providing a detection device which is capable of distinguishing whether a connected microphone or audio signal processing arrangement operates on an analog or digital basis. An analog or digital connection is selected in accordance with that determination procedure.

Consequently, there is provided a detection device which has a sensing device, a determining device and a selecting device. The sensing device senses an external signal fed to the detection device and forwards that signal to the determining device. The determining device determines whether the sensed external signal was transmitted by an analog or digital signal processing apparatus and transmits a corresponding determination signal to the selecting device. The selecting device then selects either an analog or a digital connection, in dependence on the determination signal.

By means of the detection device according to the invention, the user can readily combine digital and analog microphones and audio signal processing arrangements. In that way reliable operation is made possible in any event without disturbances.

In accordance with a configuration of the invention, the detection device has a first connection. An analog and digital output signal of a microphone can be connected to the analog and digital connection. The selecting device then outputs the signal of a microphone, received by way of the selected connection, to the connection.

In that way the detection device according to the invention can be coupled to a microphone both with an analog output and also with a digital output, in which case the detection device outputs either the analog or the digital output signal of the microphone in dependence on the external signal.

In accordance with a further configuration of the invention, the detection device has a first connection. The selecting device forwards a signal received from the first connection to the analog or digital connection according to the determination signal.

Consequently, for example, an analog or digital output signal of a microphone can be fed automatically to the corresponding analog or digital further signal processing means, by means of the selecting device.

In accordance with a preferred configuration of the invention, the sensing device is suitable for sensing the voltage at the first connection. Accordingly, the decision as to whether an analog or digital signal is applied to the detection device can be taken in accordance with the level of the applied voltage.

In accordance with a further configuration of the invention, the sensing device and the determining device are adapted to sense and evaluate a digital dialog protocol.

BRIEF DESCRIPTION OF THE DRAWINGS

The invention is described in greater detail hereinafter with reference to the drawing in which.

DESCRIPTION OF THE PREFERRED EMBODIMENTS

Figure 1:
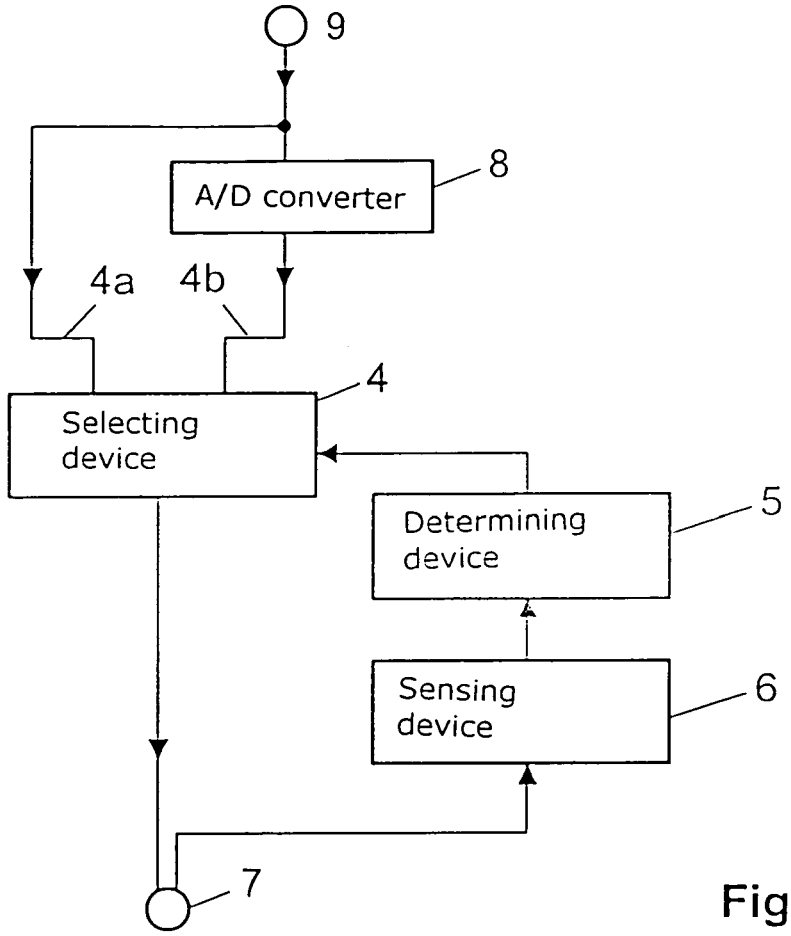
FIG. 1 shows a detection device according to a first embodiment.

FIG. 1 shows a block circuit diagram of a detection device according to a first embodiment of the invention. That detection device is particularly suitable for use with a microphone. It has a first connection 7, a sensing device 6, a determining device 5, a selecting device 4 with an analog connection 4*a* and a digital connection 4*b*, an A/D converter 8 and a second connection 9. The first connection 7 can be connected to an external audio signal processing arrangement while the second connection 9 can be connected to an external microphone. The external audio signal processing arrangement supplies either a signal voltage of 10 volts—if this is a digital output—or an output voltage of 48 volts—if this involves an analog output. The sensing device 6 detects the voltage which is applied to the first connection 7 and which is characteristic of the analog or digital mode of operation, and forwards it to the determining device 5. The level of the applied voltage is ascertained in the determining device 5, and forwarded to the selecting device 4. In accordance with the established voltage at the first connection 7, the selecting device selects the analog connection 4*a* if the voltage is 48 volts and the digital connection 4*b* if the voltage is 10 volts. Accordingly, the analog or digital output signal of a microphone is selected to correspond to whether the externally connected signal processing arrangement operates in analog or digital manner.

Figure 2:
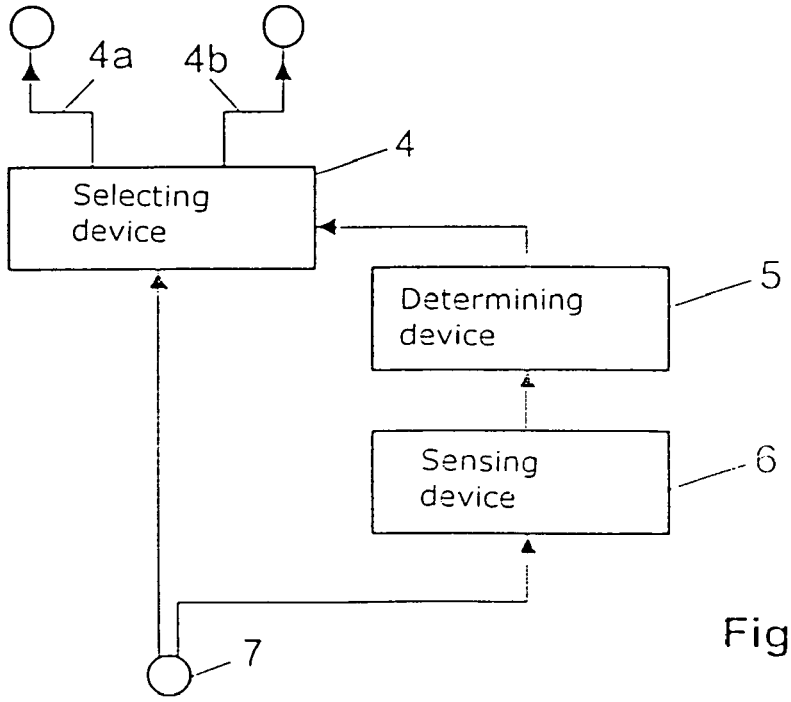
FIG. 2 shows a detection device according to a second embodiment.

FIG. 2 shows a detection device according to a second embodiment of the invention. This detection device is preferably operated at or in the signal processing arrangements such as for example a mixing desk or the like. The detection device has a first connection 7, a sensing device 6, a determining device 5 and a selecting device 4. The first connection 7 is connected to an external microphone and receives the output signals from the microphone. Those signals are sensed by the sensing device 6 and passed to the determining device 5 in which it is determined whether the signals from the microphone are analog or digital signals. The result is then passed to the selecting device 4 which, on the basis of those signals, selects either the analog connection 4*a* or the digital connection 4*b* and passes the signals received from the external microphone by way of the external connection 7, to the selected connection 4*a*, 4*b*. The analog connection 4*a* and the digital connection 4*b* can be connected to suitable processing of the analog or digital signals in the signal processing arrangement, for further processing thereof.

In a third embodiment, a microphone has the detection device according to the first embodiment. Accordingly, by means of the detection device, the microphone can determine or identify whether it is connected to an analog or digital signal processing arrangement such as for example a mixing desk. In accordance with the identification, the microphone provides an analog signal in accordance with the standard IEC 268 or a digital signal in accordance with the standard AES 42 if it is connected to an analog or a digital signal processing arrangement respectively. If the sensing and the determining device receives an applied voltage of 10 volts and a digital dialog protocol DPP in accordance with the standard AES 42, the selecting device 4 affords a digital output signal to the connection 7 corresponding to the standard AES 42.

If a voltage of 12 volts but no dialog protocol in accordance with the standard AES 42 is sensed, a further current test is conducted. If, in accordance with that current test, a current of greater than 15 mA is supplied, a digital input signal is assumed at the connection 7 and a digital output signal in accordance with the standard AES 42 is provided at the output 7 by the selecting device 4.

If a voltage of greater than 13 volts but no dialog protocol is found, an analog output signal is provided by the selecting device 4 at the connection 7. In other words, the analog connection 4*a* is selected by the selecting device 4 and passed to the connection 7. That analog output signal corresponds in that case to the standard IEC 268, that is to say there is a phantom feed.

If a voltage of 0 volt and no dialog protocol is sensed, the analog output signal at the output 4*a* of the selecting device 4 is passed to the first connection 7. It is assumed in that case that this microphone is a dynamic microphone.

In order to detect a voltage of 0 volt, the detection device has an internal voltage supply such as for example a battery for powering the device. The detection circuit with the internal voltage supply can be switched on either by way of a switch on the microphone or it can be switched on automatically upon plugging the microphone into an XLR plug.

If a voltage of 0 volt is detected at the connection 7, the capsule signal of the microphone is switched through directly by the selecting device 4 to the connection 7.

In accordance with a fourth embodiment of the invention, the detection device according to the first embodiment further has a unit for operating voltage sensing, an analog/digital converter with an output protocol in accordance with the standard AES 42. In addition the selecting device 4 has a switch for switching on or contacting the analog or digital output 4*a*, 4*b*, corresponding to the detected external signal processing arrangement. That, therefore, permits transmitter recognition, that is to say the detection device recognizes the arrangement from which (analog or digital) the microphone is supplied with the required voltage.

In that case, in accordance with the fourth embodiment, the detection device is arranged in the housing of the microphone.

In accordance with a fifth embodiment, the detection device and optionally the analog/digital converter 8 are disposed in a separate housing with an XLR plug so that the microphone can be connected to an external signal processing arrangement by way of the XLR plug.

In that case, the function of the detection device corresponds to that of the detection device in the first and second embodiments.

In accordance with a sixth embodiment of the invention, the detection device and optionally the analog/digital converter 8 is arranged in a female XLR plug of a microphone cable. In that case, the detection device at the female XLR input can be fixedly set for a digital or analog microphone or can also be designed in such a way that it can be switched over selectively.

In addition, the female XLR plug can have a display device which, in accordance with the selection of the selecting device 4, indicates whether the microphone is connected to a digital or analog signal processing arrangement.

In accordance with an eighth embodiment of the invention, a microphone described in the first, second and third embodiments has a display device which indicates whether the microphone is connected to an analog or digital signal processing arrangement.

In accordance with a ninth embodiment of the invention, the audio signal processing arrangement has a detection device in accordance with the second embodiment. In that case, the detection device checks whether an analog or digital microphone is connected to the audio signal processing arrangement. In that case, the microphone is considered as the source or transmitter.

If the sensing device 6 and the determining device 5 sense 0 volt at the connection 7, a signal voltage is provided for a dynamic microphone, that is to say ≧10 mV. An ohmic check is then carried out, with the resistance being >200Ω of 500Ω. Thereafter a signal statistics check can be carried out in order to establish whether the signal is speech or music. The switching-on conditions can be selected in accordance with the properties of the dynamic microphone.

If the sensing device 6 and the determining device 5 sense that the voltage is rising to 10 volts, the steady current consumption is checked (12 volts>10 mA≦300 mA). The digital signal flow (HP 500 kHz) is then checked. With a voltage of 12 volts, a digital dialog protocol is sent to the microphone. If the detection device then receives a positive response, the switching-on condition for a digital microphone is set on the basis of the standard AES 42. If, however, no data flow occurs, a check is made to ascertain whether the voltage rises to 48 volts with a current of ≦10 mA. A switching-on condition is then set corresponding to an analog microphone on the basis of the standard IEC 268. A signal statistic checking operation can possibly be carried out.

At HP≧500 kHz, a digital signal of 6 MHz is always sent.

The invention was admittedly described hereinbefore only in relation to cabled microphones and signal processing arrangements, but use of the detection device is also possible in wireless microphone systems in order to determine whether an analog or digital microphone or signal processing arrangement is connected. In that respect, it is immaterial whether wireless transmission takes place in analog or digital form as the only thing that is crucial for the detection device according to the invention is what signal is at the output of the receiver.

While the foregoing description and drawings represent the present invention, it will be obvious to those skilled in the art that various changes may be made therein without departing from the true spirit and scope of the present invention.

What is claimed is:

1. A microphone device comprising:

an integrated detection device for determining whether an analog or digital audio signal processing apparatus is externally connected to the detection device, and further comprising:

an output connection connected to an audio signal processing apparatus;

an input connection being adapted to receive analog and digital signals from a microphone unit;

a sensing device for sensing an external signal from the audio signal processing apparatus;

a determining device for determining whether the sensed external signal was transmitted by a digital or analog audio signal processing apparatus, and for outputting a corresponding determination signal;

a selecting device having an analog and a digital connection, the analog and digital connection adapted to receive analog and digital signals, respectively, from the microphone unit, the selective device selecting the analog or digital connection according to the determination signal; and wherein the selecting device outputs the signal from the microphone unit corresponding to the selected analog or digital connection to the output connection.

2. Apparatus as set forth in claim 1, wherein the sensing device is adapted to sense the voltage applied at the connection.

3. Apparatus as set forth in claim 2, wherein the determining device has an evaluation unit for evaluating a dialog protocol.

4. Apparatus as set forth in claim 1, wherein the sensing device, the determining device and the selecting device are respectively adapted to be activated automatically upon the making of a contact of an external microphone with the analog or digital connection.

5. Apparatus as set forth in claim 4, and further comprising:

an internal energy supply.

6. Apparatus as set forth in claim 1, comprising:

a display device for indicating whether the analog or digital connection is selected.

7. Apparatus as set forth in claim 1, wherein the integrated detection device is a wireless microphone receiving apparatus.

8. An XLR plug apparatus comprising:

an input connection being adapted to receive analog and digital signals from a microphone unit;

a sensing device for sensing an external signal from the microphone unit;

a determining device for determining whether the sensed external signal was transmitted by a digital or analog microphone unit and for outputting a corresponding determination signal;

a selecting device for selecting an analog or digital connection according to the determination signal; and an analog connection and a digital connection, each adapted to connect to an audio signal processing apparatus;

wherein the selecting device is adapted to transmit a signal received from the input connection to the analog or digital connection according to the determination signal.

* * * * *